US012642323B2

(12) United States Patent
Djelaj

(10) Patent No.: US 12,642,323 B2
(45) Date of Patent: Jun. 2, 2026

(54) HAIR EXTENSION INSTALLATION METHOD

(71) Applicant: Muse Hairpro LLC, Washington Township, MI (US)

(72) Inventor: Natasha Djelaj, Washington Township, MI (US)

(73) Assignee: Muse Hairpro LLC, Washington Township, MI (US)

( * ) Notice: Subject to any disclaimer, the term of this patent is extended or adjusted under 35 U.S.C. 154(b) by 12 days.

(21) Appl. No.: 19/039,307

(22) Filed: Jan. 28, 2025

(65) Prior Publication Data

US 2025/0169559 A1 May 29, 2025

Related U.S. Application Data

(63) Continuation-in-part of application No. 17/875,595, filed on Jul. 28, 2022, now Pat. No. 12,245,651.

(60) Provisional application No. 63/226,227, filed on Jul. 28, 2021.

(51) Int. Cl.
*A41G 5/00* (2006.01)

(52) U.S. Cl.
CPC ..... *A41G 5/006* (2013.01)

(58) Field of Classification Search
CPC ..... A41G 5/00; A41G 5/0006; A41G 5/002; A41G 5/0026; A41G 5/006; A41G 5/0013; A41G 5/004; A41G 5/0046; A41G 5/0053; A41G 5/0066; A41G 5/0073; A41G 5/0086; A41G 5/0093; A41G 3/00; A41G 3/0008;
(Continued)

(56) References Cited

U.S. PATENT DOCUMENTS 3,654,935 A 4/1972 Brown
3,777,768 A 12/1973 Scigliano
5,121,761 A 6/1992 Meister
(Continued)

FOREIGN PATENT DOCUMENTS

CZ 33297 U1 10/2019

OTHER PUBLICATIONS

YouTube, Criss-cross Beaded Weft Extensions Tutorial; "https://www.youtube.com/watch?v=QveCumx3r4l". (Year: 2021).*
(Continued)

*Primary Examiner* — Rachel R Steitz
*Assistant Examiner* — Karim Asqiriba
(74) *Attorney, Agent, or Firm* — The Dobrosin Law Firm, P.C.

(57) ABSTRACT

A method for installing weft hair extensions including sectioning a user's hair to form a part, securing beads on sections of the user's hair, and positioning a weft along the part. The method also includes locating a middle portion of a user's head and coupling the weft to the user's hair at the middle portion of the user's head by tying an anchor knot around the weft and the user's hair. The method also includes stitching a first stitching section and a second stitching section. The method also includes positioning a second weft over the first and second stitching sections and coupling the second weft to the weft and the user's hair at the middle portion of the user's head by tying a second anchor knot around the second weft, the weft, and the user's hair. The method also includes stitching a third stitching section and a fourth stitching section.

18 Claims, 10 Drawing Sheets

(58) Field of Classification Search
CPC .. A41G 3/0033; A41G 3/0041; A41G 3/0066; A41G 3/0075
See application file for complete search history.

(56) References Cited

U.S. PATENT DOCUMENTS

| | | | | |
|---|---|---|---|---|
| 7,252,093 | B2 | 8/2007 | Rodriguez | |
| 7,753,057 | B2 | 7/2010 | Kallabat et al. | |
| 7,861,729 | B2 | 1/2011 | Zephyr et al. | |
| 9,596,898 | B2 | 3/2017 | Seawright | |
| 11,419,375 | B2 | 8/2022 | Rangel | |
| 11,419,376 | B2 | 8/2022 | Turley | |
| 11,596,191 | B1 * | 3/2023 | Fazal | A41G 5/006 |
| 2005/0051186 | A1 * | 3/2005 | Smith | A41G 3/00 132/54 |
| 2006/0060212 | A1 * | 3/2006 | Rodriguez | A41G 5/0046 132/201 |
| 2008/0236605 | A1 * | 10/2008 | Russo | A41G 5/0066 132/201 |
| 2011/0197908 | A1 * | 8/2011 | Waters | A41G 5/0086 132/201 |
| 2014/0060566 | A1 * | 3/2014 | Walker | A41G 5/0073 132/201 |
| 2014/0338689 | A1 * | 11/2014 | Shuttleworth | A41G 5/0066 132/201 |
| 2019/0357614 | A1 * | 11/2019 | Rangel | A41G 5/006 |
| 2020/0113262 | A1 * | 4/2020 | Tokko | A41G 5/0066 |
| 2020/0260810 | A1 * | 8/2020 | Tokko | A41G 5/0073 |
| 2021/0059337 | A1 * | 3/2021 | Turley | A41G 5/0073 |
| 2021/0227910 | A1 * | 7/2021 | Sawyer | A41G 5/0086 |
| 2022/0030999 | A1 * | 2/2022 | Mizrahi | A41G 5/0073 |
| 2022/0295928 | A1 * | 9/2022 | Smith | A41G 5/0046 |
| 2022/0386725 | A1 * | 12/2022 | Turley | A41G 5/0073 |
| 2023/0210207 | A1 * | 7/2023 | Breci | A41G 5/006 132/201 |

OTHER PUBLICATIONS https://www.youtube.com/watch?v=bRdZ9SkgUDQ, Full Weft Extensions Installation Tutorial (2021).
https://thehairstandard.com/blog/criss-cross-beaded-weft-extensions-tutorial (Year: 2021).
YouTube Detailed La Weave Human Hair Extension Application Video and Tutorial (accessed on Jan. 23, 2026), https://www.youtube.com/watch?v=SoH07yCZK2MSounds.

* cited by examiner

HAIR EXTENSION INSTALLATION METHOD

CROSS REFERENCE TO RELATED APPLICATIONS

The present application claims the benefit of the filing date of U.S. Application No. 63/226,227, filed Jul. 28, 2021, and U.S. application Ser. No. 17/875,595, filed Jul. 28, 2022, the contents of which are expressly incorporated by reference in their entirety.

TECHNICAL FIELD

The present specification generally relates to installation of hair extensions and, more specifically, to a method of stitching to install hair extensions.

BACKGROUND

Hair extensions have been in use for many years to increase volume and/or length of hair. Hair extensions are also used to enhance the overall appearance of hair, both by length and color. While many methods of hair extension installation exist, a common method involves attaching or anchoring the extensions to a person's head or natural hair using a horizontal braided section or similar anchoring base. With this method, the extension must be sewn to the braided section or similar anchoring base using a needle and thread. A common method involves stitching a weft or plurality of wefts into a user's existing hair. A common method involves the steps of parting the user's hair into a horseshoe shape, placing beads (consecutively or in any pattern) on sections of hair, and stitching the line of wefts from the left side of the head to the right side (or vice versa). FIG. 1 illustrates the prior art and the corresponding problems. After beads are placed, wefts of hair are placed above and below the beads are sandwiched and not exposed-then the stitching begins. Using this method, problems indicated at reference numeral 100 develop. These issues include tension bald spots, and sores on the side that the stitching begins. Another issue is the lifting of the weft corners from the side that the stitching begins.

Other prior known methods of installation are also known. The video as shown by "the hair standard) (https://thehairstandard.com/blog/criss-cross-beaded-weft-extensions-tutorial/) shows installation of a weft, but it doesn't use any separate thread. While it does start in the middle, no thread is used and thus the installation is not secure. In this method, the installer starts pins in a middle section, for the sole purpose of centering the weft. The installer does NOT continue to weave from a center section towards the user's face.

U.S. Pat. No. 7,252,093 discloses a hair extension method. The method comprising gathering a first group of original hair, the first group of original hair being proximate to the portion of the scalp determined to be the location for attaching the extension hair; inserting a portion of the first group of original hair in a first band; providing a first group of artificial support material; inserting a portion of the first group of the artificial support material in the first band, the combination of the first group of original hair and the first group of artificial support material forming a first hair combination; gathering a second group of original hair, the second group of original hair being substantially proximate to the first hair combination; inserting in a second band the combination of at least one hair from the second group of original hair and a portion of the first hair combination, the hairs in between the first and the second band defining a hair track; and attaching the extension hair to the hair track. While this patent does disclose finding a center portion, the patent does NOT disclose starting the weave at a center or middle portion between the user's ears and finishing two separate weave sections near the user's face.

U.S. Pat. No. 9,595,898 discloses a brainless apparatus and method of combining natural and artificial hair. The method includes parting the person's natural hair so as to form a plurality of adjacent hair root sections forming a starter knot about a starter root section by looping the thread pair about the starter root section using the sew-in needle. A foundation is created laterally across a person's head along the part line by repeatedly looping the thread pair around respective hair root sections between the starter and ending root sections. Then, the wefted hair extension is sewn to the foundation track using the sew-in needle and the thread pair so as to form a combination of natural and artificial hair extending from the person's head. As with the prior references, the patent does NOT disclose starting the weave at a center or middle portion between the user's ears and finishing two separate weave sections near the user's face.

Accordingly, there exists a need in the art to provide an improved hair extension stitching method overcoming the aforementioned disadvantages.

SUMMARY

A weft hair extension installation method on a user, the method including the steps of sectioning the user's hair to form a part, positioning the weft along the part, securing beads on sections of hair to secure the weft to the user's hair, locating a middle portion spaced at least slightly apart from the end of the weft at the back of the user's head, the middle portion being any position located between the distal ends of the weft, but spaced apart from the distal ends at least ½ of an inch, or at least behind the first end bead by the user's face, starting a first stitching section beginning at the back of the head and moving towards the user's face, and starting a second stitching section at the same location as the first and moving toward the other side of the user's face, wherein by starting at a middle portion reduces lifting of the weft on user, reduces sore spots, and creates an increased connection of the weft to the user's hair. In some embodiments, the weft lays flat where the stitching ends. In other embodiments, the beads are made from silicone or other similar material. In some embodiments, the thread is made of cotton, cotton blend, polyester, polyester blend, plastic, plastic-like, or other similar material. In other embodiments, the stitching section uses the thickest and least sensitive hair from the back of the head.

A weft hair extension installation method as shown and described herein including the steps of locating any middle portion of the user's head after the hair is parted and a weft is placed, starting a first stitching section from the back of the user's head and moving towards their face, and starting a second stitching section at the same location as the first and moving towards the other side of the of the user's face.

A weft hair extension installation method on a user, the method including the steps of sectioning the user's hair to form a part, positioning the weft along the part, securing beads on sections of hair to secure the weft to the user's hair, cutting the weft into sections, sewing each weft to the user's head starting at a position located farthest from the user's face, starting a first stitching section beginning at the back of the head and moving towards the user's face, and starting a second stitching section at the same location as the first and moving toward the other side of the user's face wherein by starting at a middle portion reduces lifting of the weft on user, reduces sore spots, and creates an increased connection of the weft to the user's hair.

A weft hair extension installation method on a user, the method including the steps of sectioning a user's hair to form a part, securing beads on sections of the user's hair, and positioning a weft along the part. The method also includes the steps of locating a middle portion of a user's head spaced at least slightly apart from each distal end of the weft and positioned at a back of the user's head and coupling the weft to the user's hair at the middle portion of the user's head by using a thread to tie an anchor knot around the weft and the user's hair. The method also includes the steps of stitching a first stitching section using the thread beginning at the anchor knot at the middle portion of the user's head and moving towards a user's face and stitching a second stitching section using the thread beginning at the anchor knot at the middle portion of the user's head and moving toward another side of the user's face. The first stitching section and the second stitching section include a plurality of bead portions and a plurality of connection portions, where the plurality of bead portions extend approximately a length of each respective bead, and where the plurality of connection portions extend between each bead. The method also includes the steps of positioning a second weft over the first stitching section and the second stitching section and coupling the second weft to the weft and the user's hair at the middle portion of the user's head by using a second thread to tie a second anchor knot around the second weft, the weft, and the user's hair. The method also includes the step of stitching a third stitching section using the second thread beginning at the second anchor knot at the middle portion of the user's head and moving towards the user's face. Stitching a third stitching section includes alternating stitching through a bead portion of the first stitching section and stitching through a connection portion of the first stitching section. The method also includes the step of stitching a fourth stitching section using the second thread beginning at the second anchor knot at the middle portion of the user's head and moving toward the other side of the user's face. Stitching a fourth stitching section includes alternating stitching through a bead portion of the second stitching section and stitching through a connection portion of the second stitching section.

A weft hair extension installation method on a user, the method including the step of locating a middle portion of a user's head after a user's hair is parted and a weft is placed, the middle portion of the user's head being a position located between distal ends of the weft at a back of the user's head. The method also includes the step of coupling the weft to the user's hair at the middle portion of the user's head by using a thread to tie an anchor knot around the weft and the user's hair. The method also includes the steps of stitching a first stitching section using the thread beginning at the anchor knot at the middle portion of the user's head and moving towards a user's face and stitching a second stitching section using the thread beginning at the anchor knot at the middle portion of the user's head and moving towards another side of the user's face. The method also includes the steps of positioning a second weft over the first stitching section and the second stitching section and coupling the second weft to the weft and the user's hair at the middle portion of the user's head by using a second thread to tie a second anchor knot around the second weft, the weft, and the user's hair. The method also includes the step of stitching a third stitching section using the second thread beginning at the second anchor knot at the middle portion of the user's head and moving towards the user's face. The method also includes the step of stitching a fourth stitching section using the second thread beginning at the second anchor knot at the middle portion of the user's head and moving toward the other side of the user's face.

BRIEF DESCRIPTION OF THE DRAWINGS

The embodiments set forth in the drawings are illustrative and exemplary in nature and not intended to limit the subject matter. The following detailed description of the illustrative embodiments can be understood when read in conjunction with the following drawings, where like structure is indicated with like reference numerals and in which.

DETAILED DESCRIPTION

Figure 1:
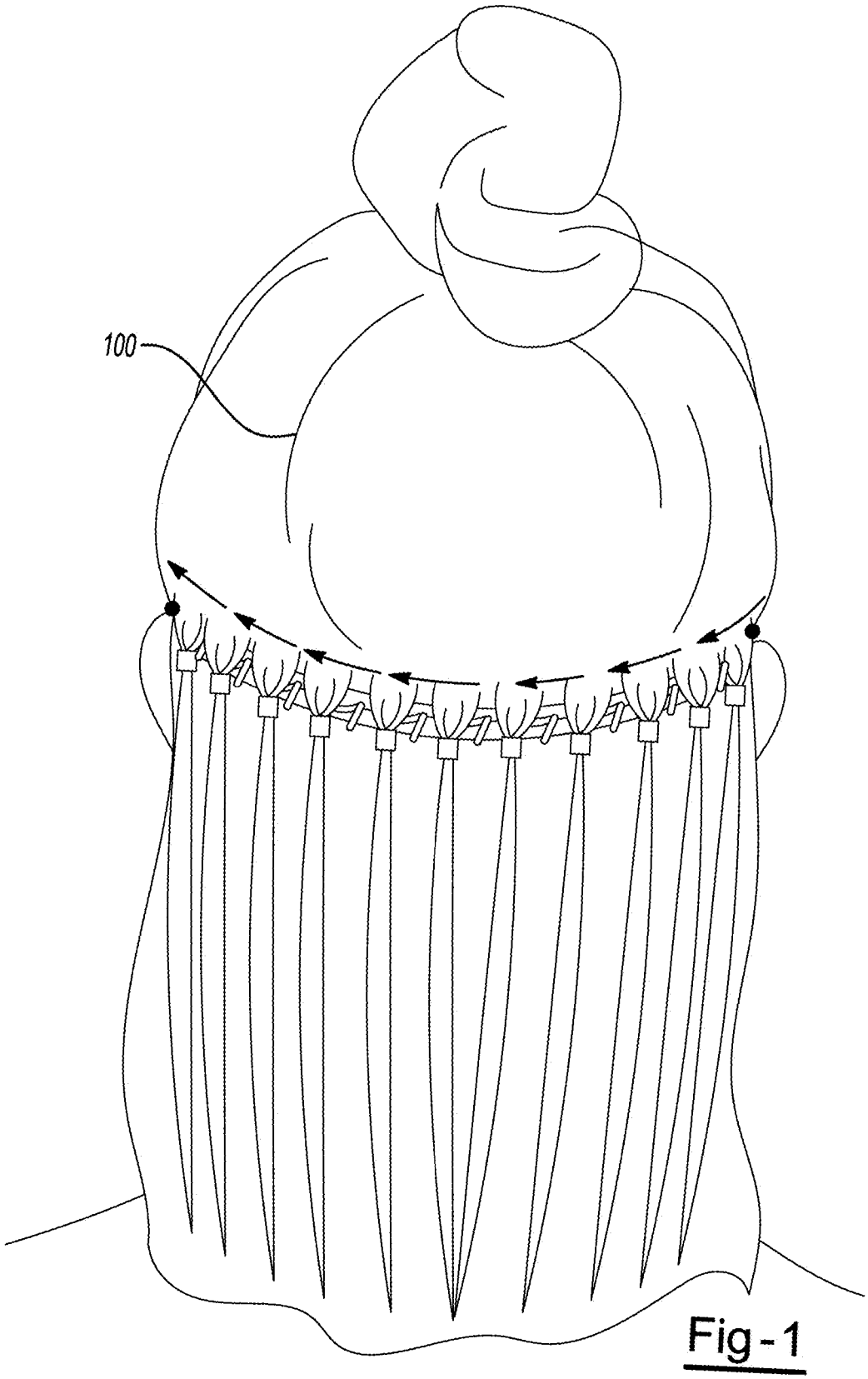
Fig-1 PRIOR ART
FIG. 1 depicts the prior art stitching method according to one or more embodiments shown and described herein.
Figure 2:
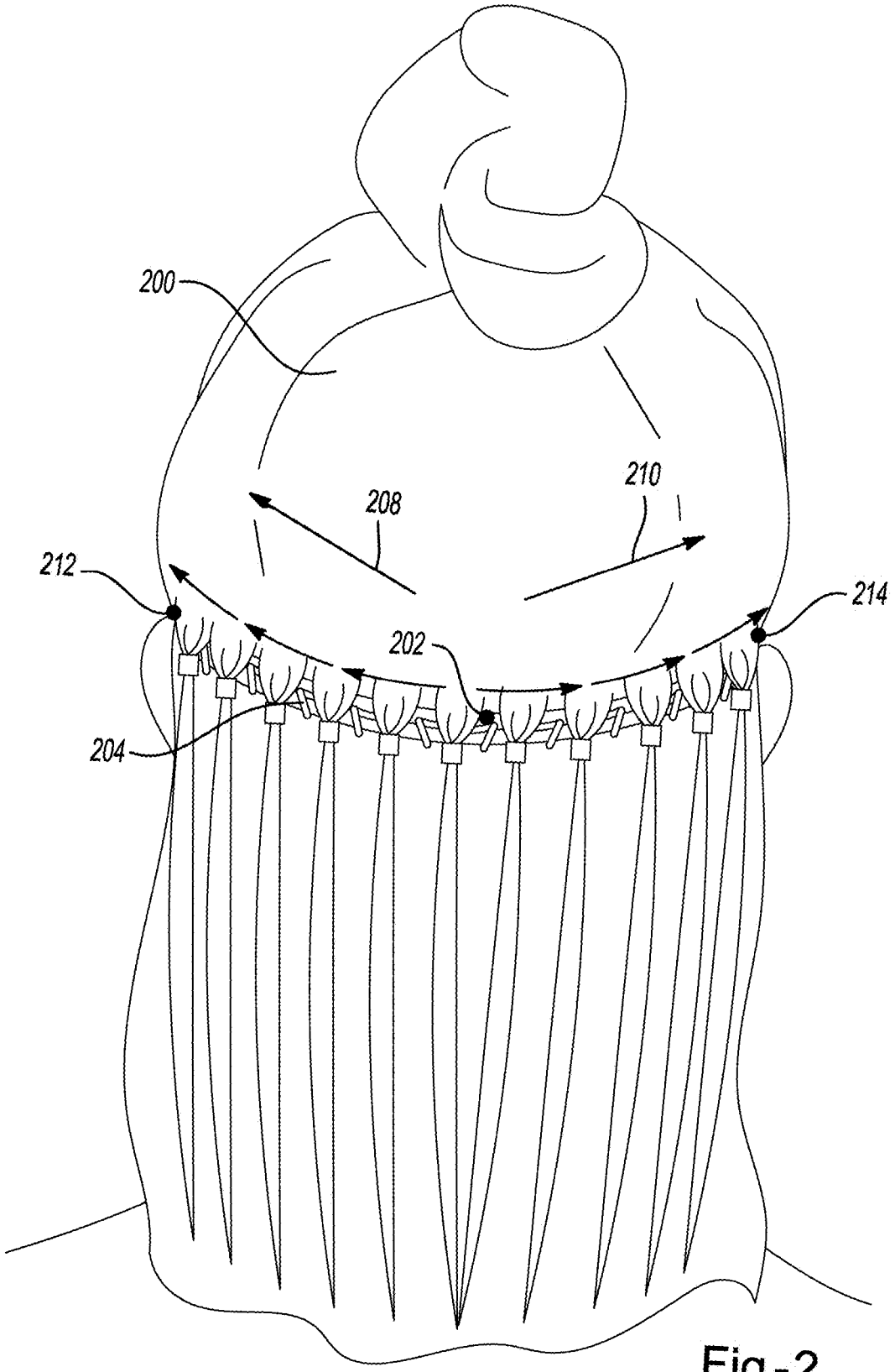
FIG. 2 depicts an improved split stitching method according to one or more embodiments shown and described herein.

The present system as disclosed herein provides for a method of installing hair extensions that alleviates prior known disadvantages of lifting, sores, bald spots . . . etc. The method of the present invention, as illustrated in FIG. 2, shows a user's head 200. The user's head 200 is covered in hair allowing the hair to be sectioned off, and for the extension artist to stitch a hair extension weft 204 thereto. Each weft includes a base with hair strands extending therefrom. In this embodiment as shown in FIG. 2, the artist begins stitching in the back center (or other starting point) of the user's head rather than the side at the end of the weft. Alternatively, the artist may start stitching at any location along the weft (not just the center) so long as it is spaced apart from the end of the weft. The hair on the back of the user's scalp is thicker (and thus more hair for the artist to stitch into), less sensitive (making the stitching more comfortable to the user), and stronger (making the hair less likely to break off and cause bald spots). The artist then begins stitching from the back of the head towards the face of the user.

Stitching begins at the center point (or middle portion) 202, as illustrated in FIG. 2. It should be appreciated that the middle portion 202 may be any starting location along the weft so long as the starting point is spaced apart from the free end of the weft, otherwise the weft may lift. The artist then begins stitching the weft in a first direction 208 towards a first end point 212. Once the first weft section installation is complete, the artist begins on the second weft section installation. The artist begins again at the middle portion 202 and begins stitching in a second direction 210 towards a second end point 214.

In general, the method includes the steps of:

sectioning the user's hair to provide a guide to the artist (into a horseshoe or other similar shape);

positioning the weft along the part;

placing beads on sections of hair;

locating any middle portion spaced at least slightly apart from the end of the user's head (or alternatively cutting the weft into sections);

starting a first stitching section and moving towards the user's face; and starting a second stitching section at the same location as the first and moving toward the other side of the user's face.

The benefits of the method and pattern as described herein include balancing the tension on either side of client's head, relieving the tension on the side of the head where the anchor knot was, and the absence of the lifting of the wefts on either side upon grow out. Further, both sides of the weft lay completely flat to the client's head. There are no tension sores for client, no bald spots, and no stress on the finer hairs by the face to the wearer of the hair extensions. If starting at a distal end of the weft, these advantages are impossible to achieve.

Other embodiments include the following. A weft hair extension installation method on a user, the method including the steps of sectioning the user's hair to form a part, positioning the weft along the part, securing beads on sections of hair to secure the weft to the user's hair, locating a middle portion spaced at least slightly apart from the end of the weft at the back of the user's head, the middle portion being any position located between the distal ends of the weft, starting a first stitching section beginning at the back of the head and moving towards the user's face, and starting a second stitching section at the same location as the first and moving toward the other side of the user's face, wherein by starting at a middle portion reduces lifting of the weft on user, reduces sore spots, and creates an increased connection of the weft to the user's hair. In some embodiments, the weft lays flat where the stitching ends. In other embodiments, the beads are made from silicone or other similar material. In some embodiments, the thread is made of cotton, cotton blend, polyester, polyester blend, plastic, plastic-like, or other similar material. In other embodiments, the stitching section uses the thickest and least sensitive hair from the back of the head.

A weft hair extension installation method as shown and described herein including the steps of locating any middle portion of the user's head after the hair is parted and a weft is placed, starting a first stitching section from the back of the user's head and moving towards their face, and starting a second stitching section at the same location as the first and moving towards the other side of the of the user's face.

A weft hair extension installation method on a user, the method including the steps of sectioning the user's hair to form a part, positioning the weft along the part, securing beads on sections of hair to secure the weft to the user's hair, cutting the weft into sections, sewing each weft to the user's head starting at a position located farthest from the user's face, starting a first stitching section beginning at the back of the head and moving towards the user's face, and starting a second stitching section at the same location as the first and moving toward the other side of the user's face wherein by starting at a middle portion reduces lifting of the weft on user, reduces sore spots, and creates an increased connection of the weft to the user's hair.

Further, this method allows the artist to use a single piece of thread for weaving. When starting at any location spaced apart from the end pieces, only one knot is required on using a single piece of thread. Alternatively, multiple pieces of thread may be utilized.

The foregoing descriptions of specific embodiments of the invention have been presented for purposes of illustration and description. They are not intended to be exhaustive or to limit the invention to the precise forms disclosed, and modifications and variations are possible in view of the above teaching. The exemplary embodiments were chosen and described to best explain the principles of the invention and its practical application, to thereby enable others skilled in the art to best utilize the invention and its embodiments with modifications as suited to the use contemplated.

With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the invention. It is noted that the terms "substantially" and "about" may be utilized herein to represent the inherent degree of uncertainty that may be attributed to any quantitative comparison, value, measurement, or other representation. Any values that may be modified by such terminology are also part of the teachings herein. For example, if a teaching recited "about 10," the skilled person should recognize that the value of 10 is also contemplated.

In this embodiment, the user will always end with 2 end knots. Accordingly, 3-4 knots are needed for the method in total. The anchor knot or knots (if the installer chooses to use a separate thread) and 2 end knots that include no back stitching or over-direction of the thread. In prior methods, a single anchor knot is used between the first and second end bead. The installer then stitches toward the face toward the end of the weft and then continues the same thread overdirecting it all the way around stitching around the head to the left and end with 1 end knot.

The method and system of the present specification offers several advantages. The system includes balanced tension on the user's hair and scalp upon initial install, and in the grow-out phase which alleviates the most common issue with extensions not being installed properly (e.g. bald spots due to tension on the hair/scalp). The current method as disclosed herein has a much faster installation time for the artist since they are working with half the amount of thread since they are stitching half the head at a time. Further, the corners of the wefts lay flat and comfortable and remain discreet for the client.

Figure 3:
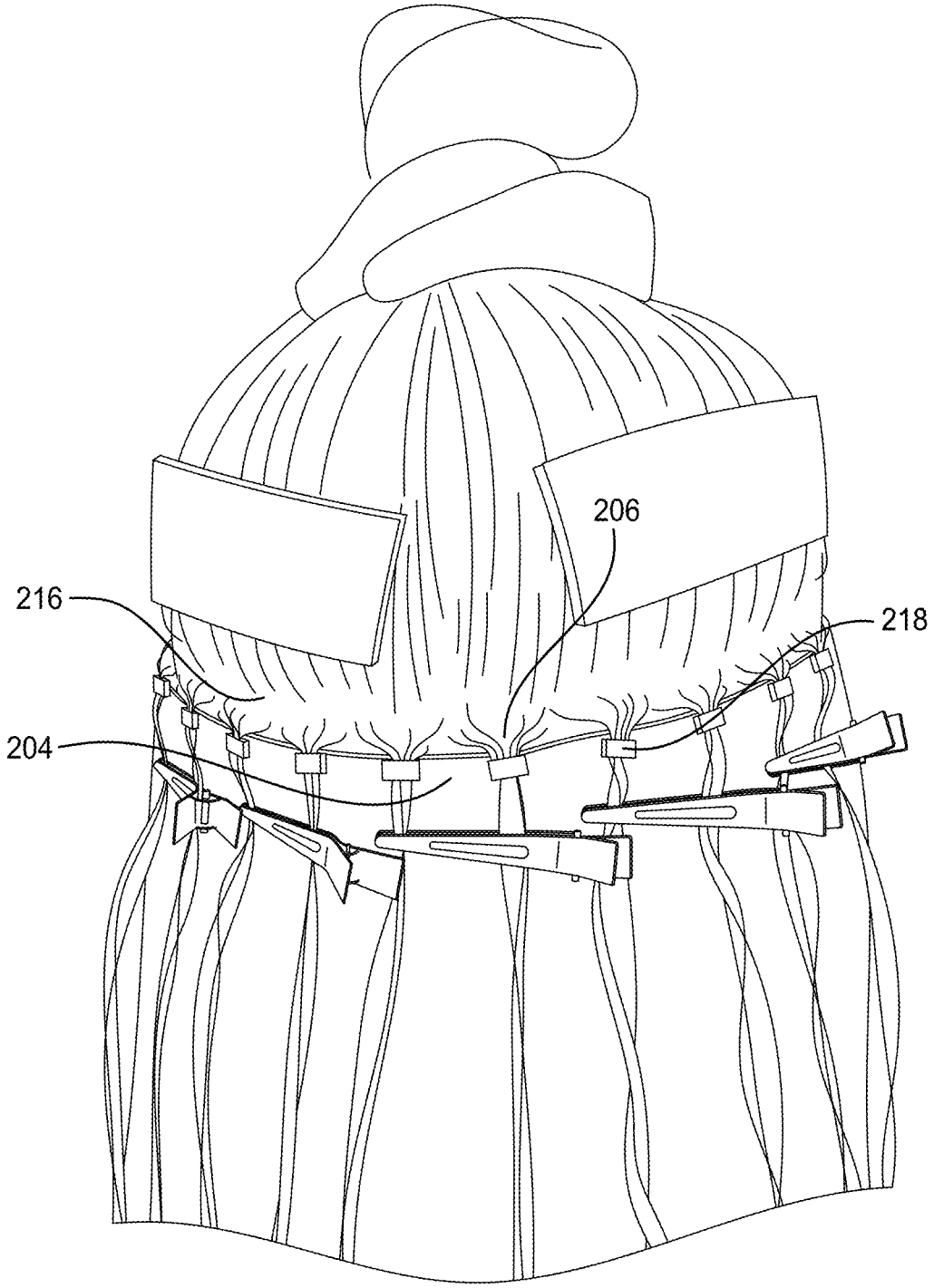
FIG. 3 depicts a user's hair sectioned via beads and forming a part with a weft placed along the part, according to an exemplary embodiment.
Figure 4:
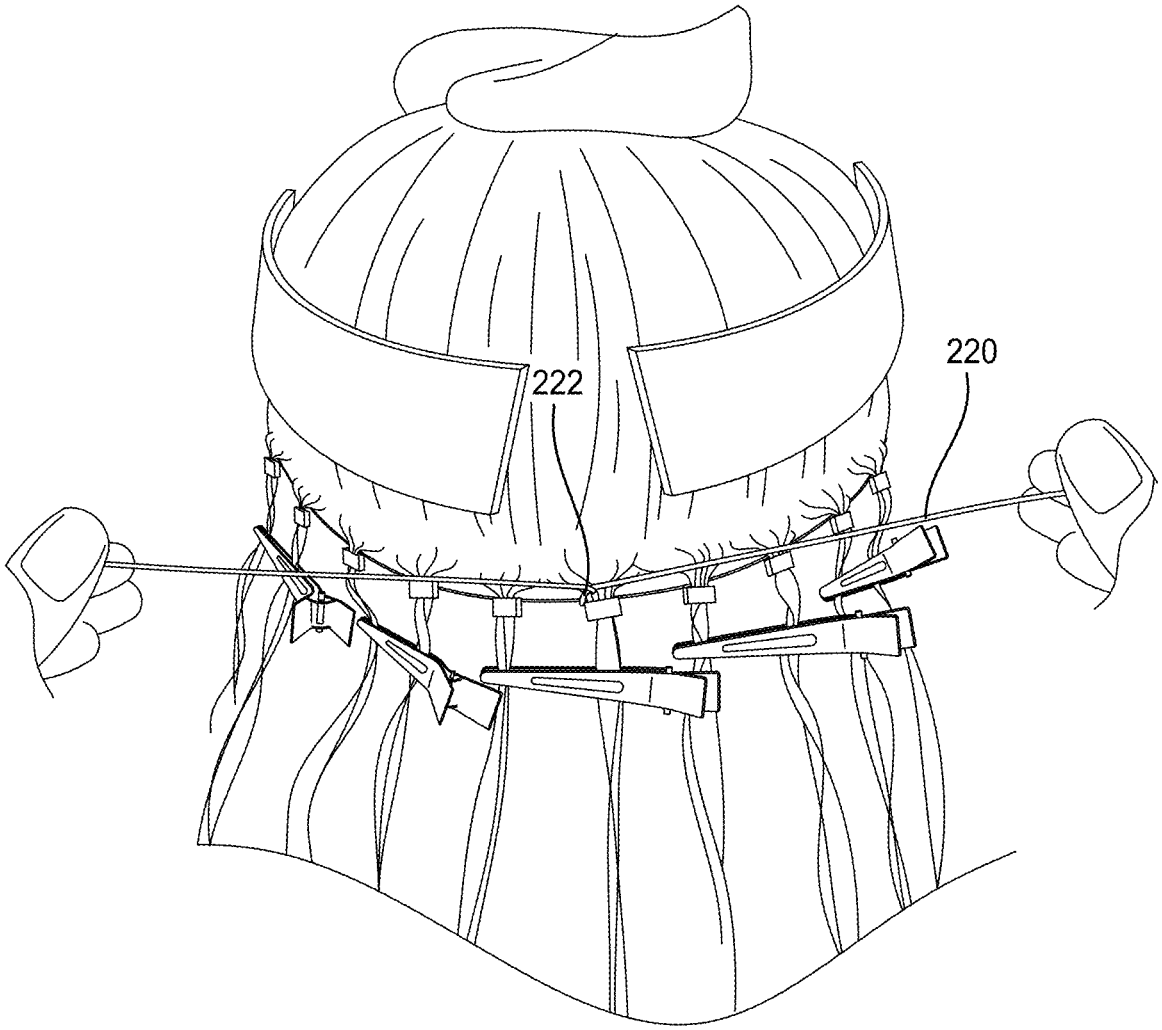
FIG. 4 depicts an anchor knot at a middle portion of the user's head which couples the weft and the user's hair, according to an exemplary embodiment.

FIGS. 3-10 illustrate another embodiment of the weft hair extension installation method on a user. FIG. 3 shows the steps of sectioning a user's hair 206 to form a part 216, securing beads 218 on sections of the user's hair 206, and positioning a weft 204 along the part 216. The beads 218 are made from silicone or other similar material. FIG. 4 shows the steps of locating a middle portion 202 of a user's head 200 spaced at least slightly apart from each distal end of the weft 204 and positioned at a back of the user's head 200 and coupling the weft 204 to the user's hair 206 at the middle portion 202 of the user's head 200 by using a thread 220 to tie an anchor knot 222 around the weft 204 and the user's hair 206. The thread 220 is made of cotton, cotton blend, polyester, polyester blend, plastic, plastic-like, or other similar material.

Figure 5:
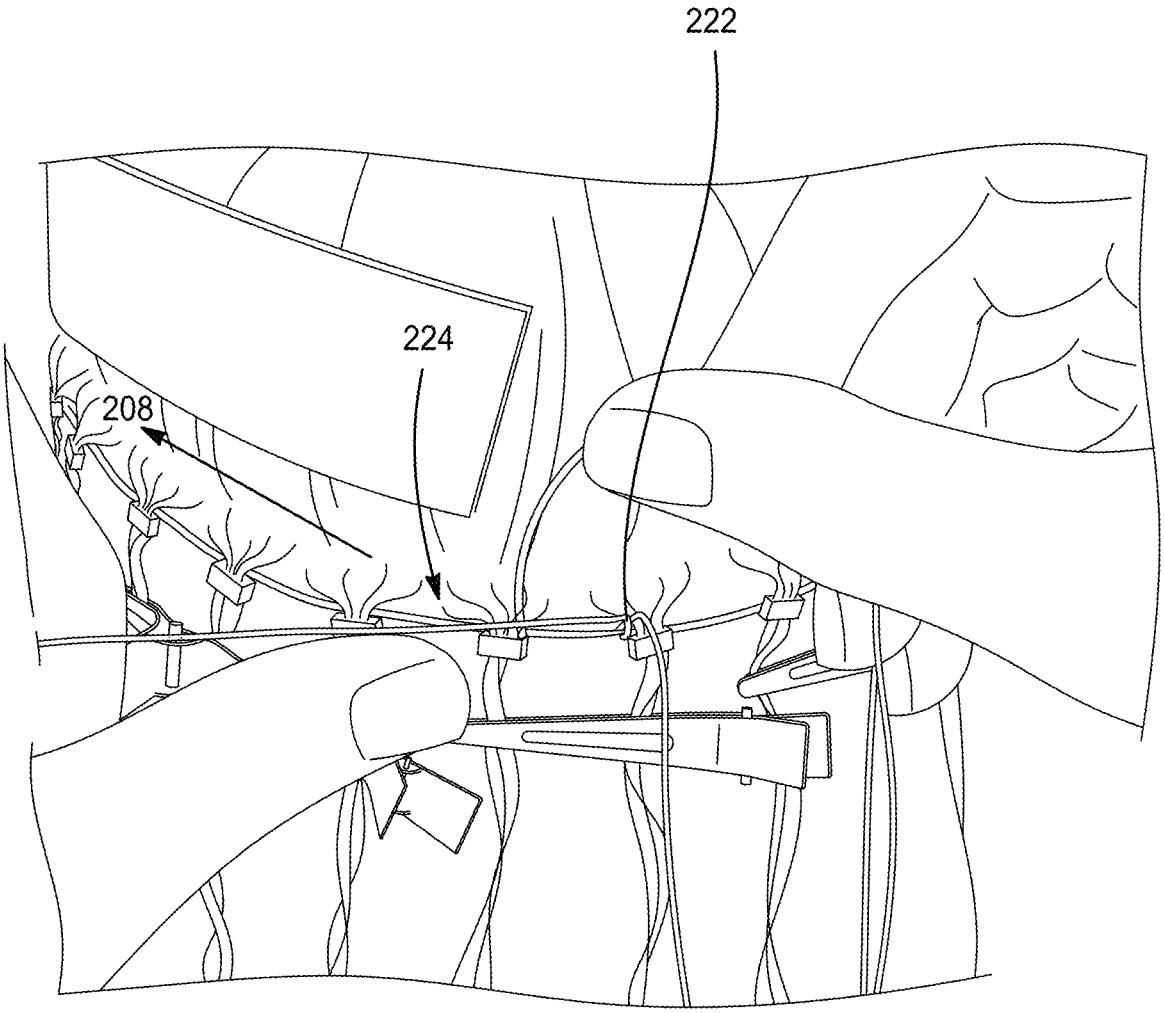
FIG. 5 depicts a first stitching section, according to an exemplary embodiment.
Figure 6:
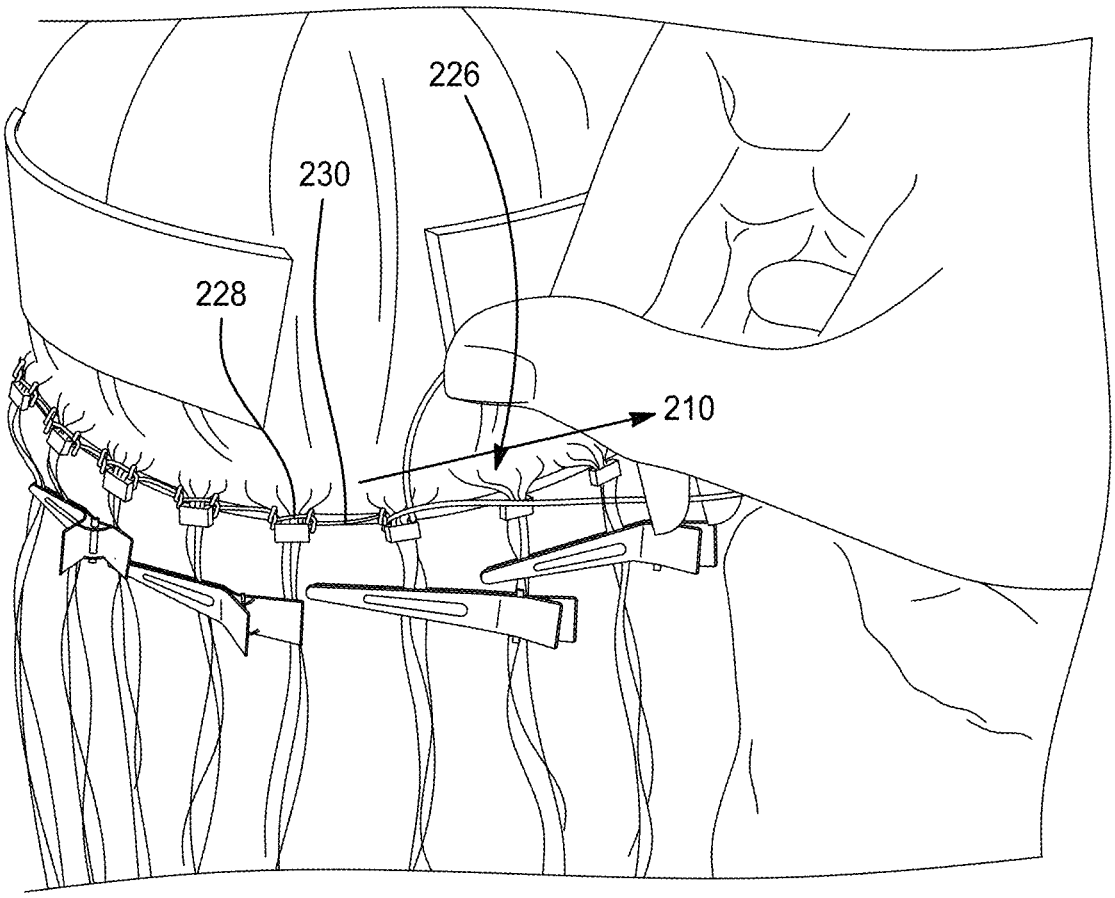
FIG. 6 depicts a second stitching section, according to an exemplary embodiment.
Figure 7:
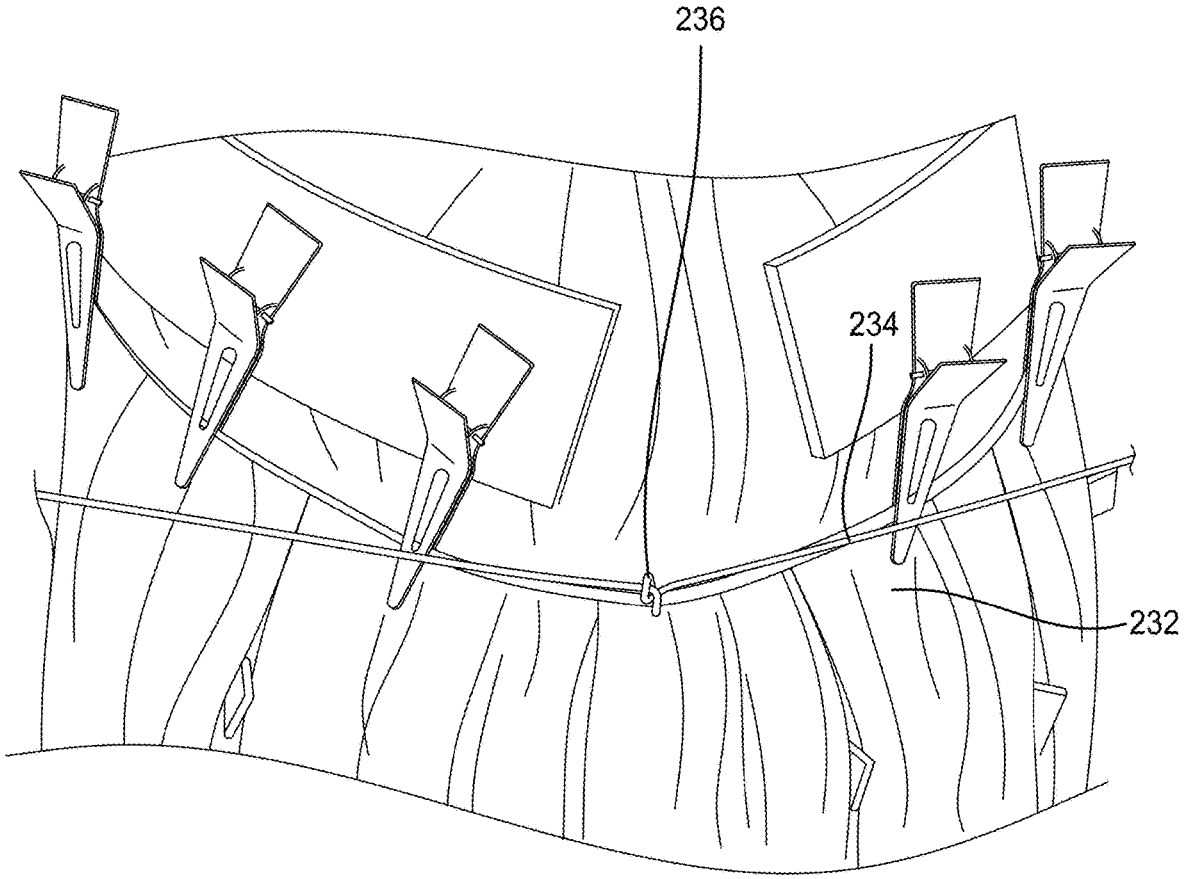
FIG. 7 depicts a second anchor knot at a middle portion of the user's head which couples the second weft, the weft, and the user's hair, according to an exemplary embodiment.

FIG. 5 shows the step of stitching a first stitching section 224 using the thread 220 beginning at the anchor knot 222 at the middle portion 202 of the user's head 200 and moving towards a user's face in a first direction 208 towards a first end point 212. FIG. 6 shows the step of stitching a second stitching section 226 using the thread 220 beginning at the anchor knot 222 at the middle portion 202 of the user's head 200 and moving toward another side of the user's face in a second direction 210 towards a second end point 214. Alternatively, stitching a first stitching section 224 may begin at any location along the weft 204 (not just the middle portion 202) so long as the beginning location is spaced apart from the end of the weft 204. The first stitching section 224 and the second stitching section 226 include a plurality of bead portions 228 and a plurality of connection portions 230. The plurality of bead portions 228 extend approximately a length of each respective bead 218 and the plurality of connection portions 230 extend between each bead 218. Distal ends of the weft 204 lay flat and are secured to the user's hair 206 by knots at a first end point 212 and a second end point 214. The first stitching section 224 and the second stitching section 226 use a thickest portion of the user's hair from the back of the user's head. Further, the stitching of the first stitching section 224 mirrors the stitching of the second stitching section 226. FIG. 7 shows the steps of positioning a second weft 232 over the first stitching section 224 and the second stitching section 226 and coupling the second weft 232 to the weft 204 and the user's hair 206 at the middle portion 202 of the user's head 200 by using a second thread 234 to tie a second anchor knot 236 around the second weft 232, the weft 204, and the user's hair 206. The second thread 234 is made of cotton, cotton blend, polyester, polyester blend, plastic, plastic-like, or other similar material.

Figure 8:
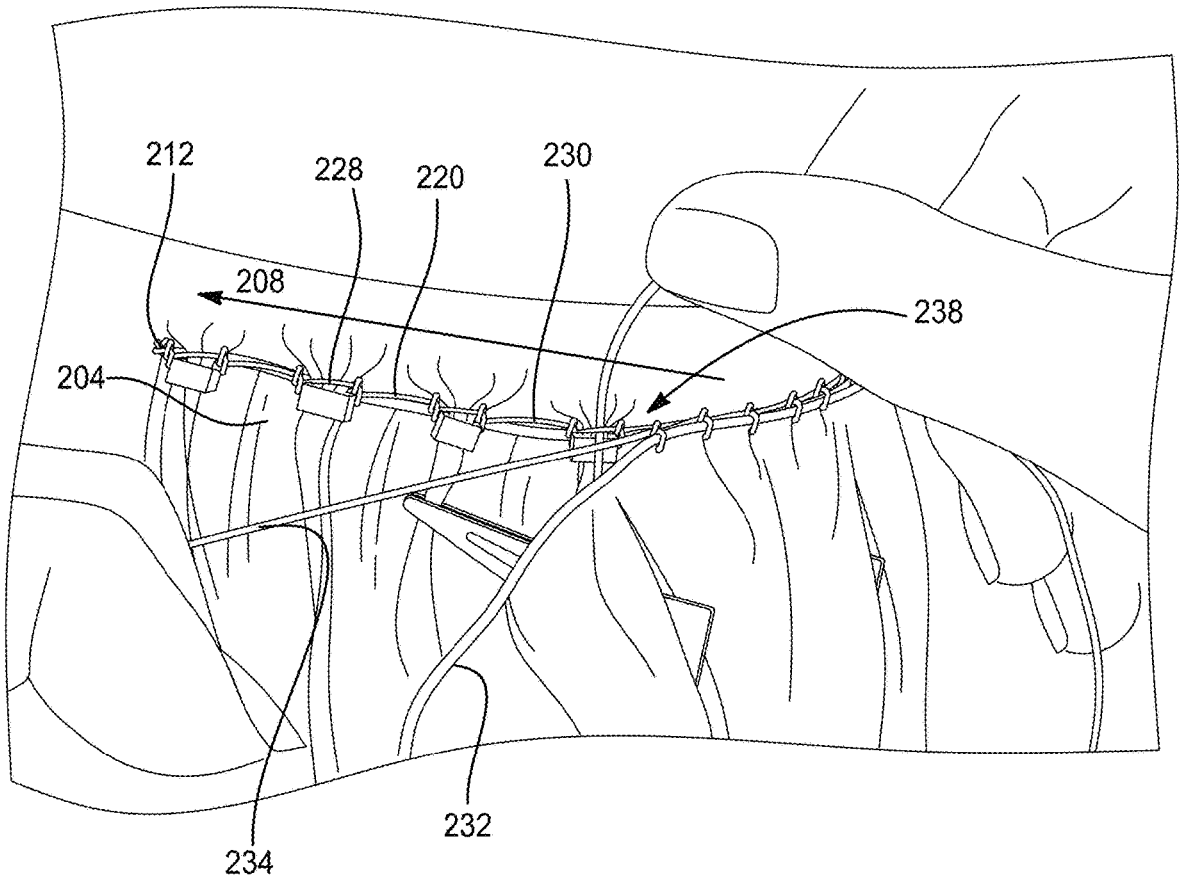
FIG. 8 depicts a third stitching section, according to an exemplary embodiment.
Figure 9:
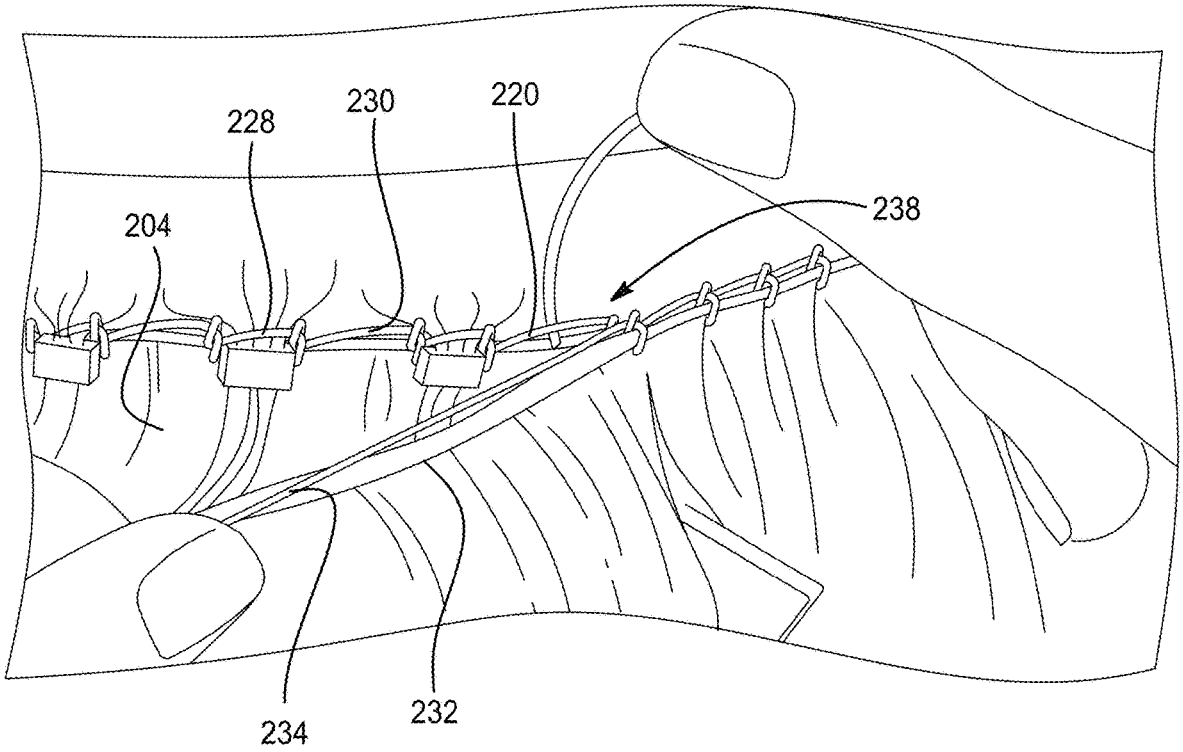
FIG. 9 depicts a third stitching section, according to an exemplary embodiment.

FIG. 8 shows the step of stitching a third stitching section 238 using the second thread 234 beginning at the second anchor knot 236 at the middle portion 202 of the user's head 200 and moving towards the user's face in a first direction 208 towards a first end point 212. Stitching a third stitching section 238 includes alternating stitching through a bead portion 228 of the first stitching section 224 (shown in FIG. 8) and stitching through a connection portion 230 of the first stitching section 224 (shown in FIG. 9).

Figure 10:
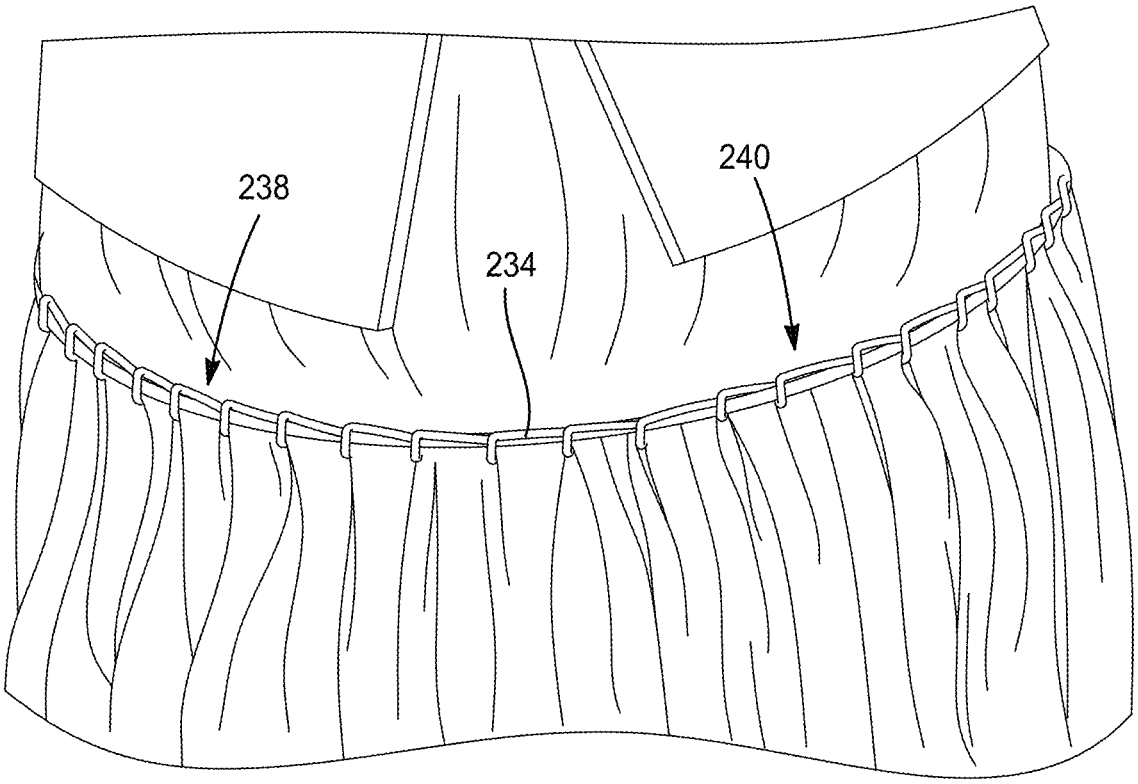
FIG. 10 depicts a third stitching section and a fourth stitching section, according to an exemplary embodiment.

The method also includes the step of stitching a fourth stitching section 240 using the second thread 234 beginning at the second anchor knot 236 at the middle portion 202 of the user's head 200 and moving toward the other side of the user's face in a second direction 210 towards a second end point 214. Stitching a fourth stitching section 240 includes alternating stitching through a bead portion 228 of the second stitching section 226 and stitching through a connection portion 230 of the second stitching section 226. Distal ends of the second weft 232 lay flat and are secured to the user's hair 206 by knots at a first end point 212 and a second end point 214. FIG. 10 shows the third stitching section 238 and the fourth stitching section 240. The stitching of the third stitching section 238 mirrors the stitching of the fourth stitching section 240. Further, stitching the third stitching section 238 and the fourth stitching section 240 couples the second weft 232 to the weft 204, where the second weft 232 covers the beads 218. Additionally, starting at the middle portion 202 of the user's head 200 reduces lifting of the weft 204 and the second weft 232 relative to the user's hair 206, reduces sore spots, and improves balance of the weft 204 and the second weft 232 relative to the user's hair 206.

In another embodiment of the weft hair extension installation method on a user, the method includes a step of locating a middle portion 202 of a user's head 200 after a user's hair 206 is parted and a weft 204 is placed. The middle portion 202 of the user's head 200 is a position located between distal ends of the weft 204 at a back of the user's head 200. The method also includes a coupling the weft 204 to the user's hair 206 at the middle portion 202 of the user's head 200 by using a thread 220 to tie an anchor knot 222 around the weft 204 and the user's hair 206. The thread 220 is made of cotton, cotton blend, polyester, polyester blend, plastic, plastic-like, or other similar material.

The method also includes stitching a first stitching section 224 using the thread 220 beginning at the anchor knot 222 at the middle portion 202 of the user's head 200 and moving towards a user's face. The method also includes stitching a second stitching section 226 using the thread 220 beginning at the anchor knot 222 at the middle portion 202 of the user's head 200 and moving towards another side of the user's face. Alternatively, stitching a first stitching section 224 may begin at any location along the weft 204 (not just the middle portion 202) so long as the beginning location is spaced apart from the end of the weft 204. The distal ends of the weft 204 lay flat and are secured to the user's hair 206 by knots at a first end point 212 and a second end point 214. Additionally, the first stitching section 224 and the second stitching section 226 use a thickest portion of the user's hair 206 from the back of the user's head 200. Further, the stitching of the first stitching section 224 mirrors the stitching of the second stitching section 226.

The method also includes positioning a second weft 232 over the first stitching section 224 and the second stitching section 226 and coupling the second weft 232 to the weft 204 and the user's hair 206 at the middle portion 202 of the user's head 200 by using a second thread 234 to tie a second anchor knot 236 around the second weft 232, the weft 204, and the user's hair 206. The second thread 234 is made of cotton, cotton blend, polyester, polyester blend, plastic, plastic-like, or other similar material.

The method also includes stitching a third stitching section 238 using the second thread 234 beginning at the second anchor knot 236 at the middle portion 202 of the user's head 200 and moving towards the user's face. The method also includes stitching a fourth stitching section 240 using the second thread 234 beginning at the second anchor knot 236 at the middle portion 202 of the user's head 200 and moving toward the other side of the user's face. Distal ends of the second weft 232 lay flat and are secured to the user's hair 206 by knots at a first end point 212 and a second end point 214. Further, the stitching of the third stitching section 238 mirrors the stitching of the fourth stitching section 240. Additionally, starting at the middle portion 202 of the user's head 200 reduces lifting of the weft 204 and the second weft 232 relative to the user's hair 206, reduces sore spots, and improves balance of the weft 204 and the second weft 232 relative to the user's hair 206.

These terms are also utilized herein to represent the degree by which a quantitative representation may vary from a stated reference without resulting in a change in the basic function of the subject matter at issue.

As used herein, unless otherwise stated, the teachings envision that any member of a genus (list) may be excluded from the genus; and/or any member of a Markush grouping may be excluded from the grouping.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate.

These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consist of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

It is therefore intended that the appended claims (and/or any future claims filed in any corresponding application) cover all such changes and modifications that are within the scope of the claimed subject matter.

What is claimed is:

1. A weft hair extension installation method on a user, the hair extension installation method comprising steps of:

sectioning a user's hair to form a part;

securing beads on sections of the user's hair;

positioning a weft along the part;

locating a middle portion of a user's head spaced at least slightly apart from each distal end of the weft and positioned at a back of the user's head;

coupling the weft to the user's hair at the middle portion of the user's head by using a thread to tie an anchor knot around the weft and the user's hair;

stitching a first stitching section using the thread beginning at the anchor knot at the middle portion of the user's head and moving towards a user's face, stitching a second stitching section using the thread beginning at the anchor knot at the middle portion of the user's head and moving toward another side of the user's face, wherein the first stitching section and the second stitching section include a plurality of bead portions and a plurality of connection portions, wherein the plurality of bead portions extend approximately a length of each respective bead, and wherein the plurality of connection portions extend between each bead;

positioning a second weft over the first stitching section and the second stitching section;

coupling the second weft to the weft and the user's hair at the middle portion of the user's head by using a second thread to tie a second anchor knot around the second weft, the weft, and the user's hair;

stitching a third stitching section using the second thread beginning at the second anchor knot at the middle portion of the user's head and moving towards the user's face, wherein the stitching the third stitching section includes alternating stitching through a bead portion of the first stitching section and stitching through a connection portion of the first stitching section;

stitching a fourth stitching section using the second thread beginning at the second anchor knot at the middle portion of the user's head and moving toward the other side of the user's face, wherein the stitching the fourth stitching section includes alternating stitching through a bead portion of the second stitching section and stitching through a connection portion of the second stitching section.

2. The hair extension installation method according to claim 1, wherein the distal ends of the weft lay flat and are secured to the user's hair by knots at a first end point and a second end point.

3. The hair extension installation method according to claim 1, wherein distal ends of the second weft lay flat and are secured to the user's hair by knots at a first end point and a second end point.

4. The hair extension installation method according to claim 1, wherein the beads are made from silicone.

5. The hair extension installation method according to claim 1, wherein the thread and the second thread are made of cotton, cotton blend, polyester, polyester blend, plastic.

6. The hair extension installation method according to claim 1, wherein the first stitching section and the second stitching section use a thickest portion of the user's hair from the back of the user's head.

7. The hair extension installation method according to claim 1, wherein the stitching of the first stitching section mirrors the stitching of the second stitching section.

8. The hair extension installation method according to claim 1, wherein the stitching of the third stitching section mirrors the stitching of the fourth stitching section.

9. The hair extension installation method according to claim 1, wherein starting at the middle portion of the user's head reduces lifting of the weft and the second weft relative to the user's hair, reduces sore spots, and improves balance of the weft and the second weft relative to the user's hair.

10. The hair extension installation method according to claim 1, wherein the stitching the third stitching section and the stitching the fourth stitching section couples the second weft to the weft, and wherein the second weft covers the beads.

11. A weft hair extension installation method, the hair extension installation method comprising:

locating a middle portion of a user's head after a user's hair is parted and a weft is placed, the middle portion of the user's head being a position located between distal ends of the weft at a back of the user's head;

coupling the weft to the user's hair at the middle portion of the user's head by using a thread to tie an anchor knot around the weft and the user's hair;

stitching a first stitching section using the thread beginning at the anchor knot at the middle portion of the user's head and moving towards a user's face;

stitching a second stitching section using the thread beginning at the anchor knot at the middle portion of the user's head and moving towards another side of the user's face;

positioning a second weft over the first stitching section and the second stitching section;

coupling the second weft to the weft and the user's hair at the middle portion of the user's head by using a second thread to tie a second anchor knot around the second weft, the weft, and the user's hair;

stitching a third stitching section using the second thread beginning at the second anchor knot at the middle portion of the user's head and moving towards the user's face; wherein the stitching the third stitching section includes alternating stitching through a bead portion of the first stitching section and stitching through a connection portion of the first stitching section; and stitching a fourth stitching section using the second thread beginning at the second anchor knot at the middle portion of the user's head and moving toward the other side of the user's face; wherein the stitching the fourth stitching section includes alternating stitching through a bead portion of the second stitching section and stitching through a connection portion of the second stitching section.

12. The hair extension installation method according to claim 11, wherein the distal ends of the weft lay flat and are secured to the user's hair by knots at a first end point and a second end point.

13. The hair extension installation method according to claim 11, wherein distal ends of the second weft lay flat and are secured to the user's hair by knots at a first end point and a second end point.

14. The hair extension installation method according to claim 11, wherein the thread and the second thread are made of cotton, cotton blend, polyester, polyester blend, plastic.

15. The hair extension installation method according to claim 11, wherein the first stitching section and the second stitching section use a thickest portion of the user's hair from the back of the user's head.

16. The hair extension installation method according to claim 11, wherein the stitching of the first stitching section mirrors the stitching of the second stitching section.

17. The hair extension method according to claim 11, wherein the stitching of the third stitching section mirrors the stitching of the fourth stitching section.

18. The hair extension method according to claim 11, wherein starting at the middle portion of the user's head reduces lifting of the weft and the second weft relative to the user's hair, reduces sore spots, and improves balance of the weft and the second weft relative to the user's hair.

* * * * *